US006585006B1

(12) United States Patent
Wilson et al.

(10) Patent No.: US 6,585,006 B1
(45) Date of Patent: Jul. 1, 2003

(54) PAPERMAKER'S FORMING FABRIC WITH COMPANION YARNS

(75) Inventors: Robert G. Wilson, Wake Forest, NC (US); Brian Herbert Pike Troughton, Herne Bay (GB)

(73) Assignee: Weavexx Corporation, Wake Forest, NC (US)

( * ) Notice: Subject to any disclaimer, the term of this patent is extended or adjusted under 35 U.S.C. 154(b) by 0 days.

(21) Appl. No.: 09/501,753

(22) Filed: Feb. 10, 2000

(51) Int. Cl.[7] ..... D03D 11/00
(52) U.S. Cl. ..... 139/383 A; 139/410
(58) Field of Search ..... 139/383 A, 410; 162/348

(56) References Cited

U.S. PATENT DOCUMENTS

| | | | | |
|---|---|---|---|---|
| 2,172,430 | A | 9/1939 | Barrell | 139/383 |
| 2,554,034 | A | 5/1951 | Koester et al. | 139/426 |
| 3,094,149 | A | 6/1963 | Keily | 139/383 |
| 3,325,909 | A | 6/1967 | Clark | 34/95 |
| 4,093,512 | A | 6/1978 | Fleischer | 162/348 |
| 4,182,381 | A | 1/1980 | Gisbourne | 139/383 |
| 4,244,543 | A | 1/1981 | Ericson | 248/55 |
| 4,289,173 | A | 9/1981 | Miller | 139/383 |
| 4,290,209 | A | 9/1981 | Buchanan et al. | 34/123 |
| 4,414,263 | A | 11/1983 | Miller et al. | 428/234 |

(List continued on next page.)

FOREIGN PATENT DOCUMENTS

| | | | |
|---|---|---|---|
| CA | 1115177 | 12/1981 | D03D/1/00 |
| DE | 3329740 | 3/1985 | |
| EP | 0 048 962 | 9/1981 | D03D/1/00 |
| EP | 0 158 710 | 10/1984 | D03D/1/00 |
| EP | 0 185 177 | 10/1985 | D03D/11/00 |
| EP | 0 224 276 | 12/1986 | D21F/1/00 |
| EP | 0 264 881 | 10/1987 | D21F/1/00 |
| EP | 0 269 070 | 11/1987 | D03D/11/00 |
| EP | 0 284 575 | 2/1988 | D21F/1/00 |
| EP | 0 283 181 | 3/1988 | D21F/1/00 |

(List continued on next page.)

OTHER PUBLICATIONS

Warren, C.A., "The Importance of Yarn Properties in Wet–End Wire Construction," Seminar, The Theory of Water Removal, Dec. 12, 1979.
International Search Report for PCT Application No. PCT/US97/18629.
Rule 132 Declaration of Robert G. Wilson (Jun. 25, 1997).

*Primary Examiner*—John J. Calvert
*Assistant Examiner*—Robert H Muromoto
(74) *Attorney, Agent, or Firm*—Myers Bigel Sibley & Sajovec

(57) ABSTRACT

A papermaker's fabric includes a base fabric structure including machine direction yarns and primary cross machine direction yarns interlacing to form a papermaking surface, wherein the machine direction yarns and primary cross machine direction yarns are interlaced in a pattern having a harness repeat of greater than two. The fabric also includes first and second companion cross machine direction yarns positioned between each pair of adjacent primary cross machine direction yarns. Each first companion cross machine direction yarn has an interlacing pattern relative to the machine direction yarns that is identical to a first of the pair of adjacent primary cross machine direction yarns, and each second companion cross machine direction yarn has an interlacing pattern relative to the machine direction yarns that is identical to a second of the pair of adjacent primary cross machine direction yarns. The first companion cross machine direction yarn is positioned between the second primary and companion cross machine direction yarns. The primary cross machine direction yarns have a first diameter, and the first and second companion yarns have a second diameter, wherein the ratio between the first and second diameters is between about 0.9 and 1.1.

23 Claims, 5 Drawing Sheets

U.S. PATENT DOCUMENTS

| | | | | |
|---|---|---|---|---|
| 4,438,788 | A | 3/1984 | Harwood | 139/383 |
| 4,452,284 | A | 6/1984 | Eckstein et al. | 139/383 |
| 4,453,573 | A | 6/1984 | Thompson | 139/383 |
| 4,501,303 | A | 2/1985 | Osterberg | 139/425 |
| 4,515,853 | A | 5/1985 | Borel | 428/257 |
| 4,529,013 | A | 7/1985 | Miller | 139/383 |
| 4,564,052 | A | 1/1986 | Borel | 139/425 |
| 4,592,395 | A | 6/1986 | Borel | 139/383 |
| 4,592,396 | A | 6/1986 | Borel et al. | 139/425 |
| 4,605,585 | A | 8/1986 | Johansson | 428/224 |
| 4,611,639 | A | 9/1986 | Bugge | 139/383 |
| 4,621,663 | A | 11/1986 | Malmendier | 139/383 |
| 4,633,596 | A | 1/1987 | Josef | 34/116 |
| 4,636,426 | A | 1/1987 | Fleischer | 428/224 |
| 4,642,261 | A | 2/1987 | Fearnhead | 428/225 |
| 4,676,278 | A | 6/1987 | Dutt | 139/383 |
| 4,705,601 | A | 11/1987 | Chiu | 162/348 |
| 4,709,732 | A | 12/1987 | Kinnunen | 139/383 |
| 4,729,412 | A | 3/1988 | Bugge | 139/383 |
| 4,731,281 | A | 3/1988 | Fleischer | 428/196 |
| 4,739,803 | A | 4/1988 | Borel | 139/383 |
| 4,755,420 | A | 7/1988 | Baker et al. | 428/222 |
| 4,759,975 | A | 7/1988 | Sutherland et al. | 428/234 |
| 4,815,499 | A | 3/1989 | Johnson | 139/383 |
| 4,815,503 | A | 3/1989 | Borel | 139/383 |
| 4,909,284 | A | 3/1990 | Kositzke | 139/383 |
| RE33,195 | E | 4/1990 | McDonald et al. | 139/425 |
| 4,934,414 | A | 6/1990 | Borel | 139/383 |
| 4,941,514 | A | 7/1990 | Taipale | 139/383 |
| 4,942,077 | A | 7/1990 | Wendt et al. | 428/152 |
| 4,945,952 | A | 8/1990 | Vöhringer | 139/383 |
| 4,967,805 | A | 11/1990 | Chiu et al. | 139/383 |
| 4,987,929 | A | 1/1991 | Wilson | 139/383 |
| 4,989,647 | A | 2/1991 | Marchand | 139/383 |
| 4,989,648 | A | 2/1991 | Tate et al. | 139/383 |
| 4,998,568 | A | 3/1991 | Vöhringer | 139/383 |
| 4,998,569 | A | 3/1991 | Tate | 139/383 |
| 5,025,839 | A | 6/1991 | Wright | 139/383 |
| 5,074,339 | A | 12/1991 | Vöhringer | 139/383 |
| 5,084,326 | A | 1/1992 | Vöhringer | 428/194 |
| 5,092,372 | A | 3/1992 | Fitzka et al. | 139/383 |
| 5,101,866 | A | 4/1992 | Quigley | 139/383 |
| 5,116,478 | A | 5/1992 | Tate et al. | 162/358 |
| 5,152,326 | A | 10/1992 | Vöhringer | 139/383 |
| 5,158,118 | A | 10/1992 | Tate et al. | 139/383 |
| 5,219,004 | A | 6/1993 | Chiu | 139/383 |
| 5,228,482 | A | 7/1993 | Fleischer | 139/383 |
| 5,358,014 | A | 10/1994 | Kovar | 139/383 |
| 5,421,374 | A | 6/1995 | Wright | 139/383 |
| 5,421,375 | A | 6/1995 | Praetzel | 139/383 |
| 5,429,686 | A | 7/1995 | Chiu et al. | 139/383 |
| 5,449,026 | A | 9/1995 | Lee | 139/383 |
| 5,454,405 | A | 10/1995 | Hawes | 139/383 |
| 5,456,293 | A | 10/1995 | Ostermayer et al. | 139/383 |
| 5,465,764 | A | 11/1995 | Eschmann et al. | 139/383 |
| 5,482,567 | A | 1/1996 | Barreto | 139/383 |
| 5,487,414 | A | 1/1996 | Kuji et al. | 139/383 |
| 5,518,042 | A | 5/1996 | Wilson | 139/383 |
| 5,520,225 | A | 5/1996 | Quigley et al. | 139/383 |
| 5,542,455 | A | 8/1996 | Ostermayer et al. | 139/383 |
| 5,555,917 | A | 9/1996 | Quigley | 139/383 |
| 5,564,475 | A | 10/1996 | Wright | 139/383 |
| 5,641,001 | A | 6/1997 | Wilson | 139/383 |
| 5,651,394 | A | 7/1997 | Marchand | 139/383 |
| 5,709,250 | A | 1/1998 | Ward et al. | 139/383 |
| RE35,777 | E | 4/1998 | Givin | 139/383 |
| 5,746,257 | A | 5/1998 | Fry | 139/383 |
| 5,826,627 | A | 10/1998 | Seabrook et al. | 139/383 |
| 5,881,764 | A | 3/1999 | Ward | 139/383 |
| 5,937,914 | A | 8/1999 | Wilson | 139/383 |
| 5,967,195 | A | 10/1999 | Ward | 139/383 |
| 5,983,953 | A | 11/1999 | Wilson | 139/383 |

FOREIGN PATENT DOCUMENTS

| | | | |
|---|---|---|---|
| EP | 0 350 673 | 6/1989 | D21F/1/00 |
| EP | 0 408 849 A2 | 5/1990 | D21F/1/00 |
| EP | 0 408 849 A3 | 5/1990 | D21F/1/00 |
| EP | 0 672 782 | 3/1996 | D21F/1/00 |
| EP | 0 794 283 | 9/1997 | D21F/1/00 |
| FR | 2 597 123 | 4/1986 | |
| FR | 86 05115 | 4/1986 | |
| GB | 2 157 328 | 10/1985 | D03D/1/00 |
| GB | 2 245 006 | 12/1991 | D03D/11/00 |
| GB | 2 264 284 a | 8/1993 | |
| JP | 2-277848 | 11/1990 | D03D/15/00 |
| JP | 8-158285 | 12/1994 | D21F/1/10 |
| JP | 9-41282 | 7/1995 | D21F/1/18 |
| JP | 9-87990 | 9/1995 | D21F/1/10 |
| JP | 11214476 | 8/1999 | |
| WO | WO86/00099 | 1/1986 | D21F/1/00 |
| WO | WO89/09848 | 10/1989 | D03D/23/00 |
| WO | WO93/10304 | 5/1993 | D21F/1/10 |
| WO | WO 00/37338 | 6/2000 | |

PAPERMAKER'S FORMING FABRIC WITH COMPANION YARNS

FIELD OF THE INVENTION

This invention relates generally to woven fabrics, and relates more specifically to woven fabrics for papermakers.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rollers. The belt, often referred to as a "forming fabric", provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity alone or with assistance from one or more suction boxes located on the lower surface (i.e., the "machine side") of the upper run of the fabric.

After leaving the forming section, the paper web is transferred to a press section of the paper machine, in which it is passed through the nips of one or more pairs of pressure rollers covered with another fabric, typically referred to as a "press felt." Pressure from the rollers removes additional moisture from the web; the moisture removal is often enhanced by the presence of a "batt" layer on the press felt. The paper is then conveyed to a drier section for further moisture removal. After drying, the paper is ready for secondary processing and packaging.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing a pin-seamable flap on each end or a special foldback, then reweaving these into pin-seamable loops. In a flat woven papermaker's fabric, the warp yarns extend in the machine direction and the filling yarns extend in the cross machine direction. In the second technique, fabrics are woven directly in the form of a continuous belt with an endless weaving process. In the endless weaving process, the warp yarns extend in the cross machine direction and the filling yarns extend in the machine direction. As used herein, the terms "machine direction" (MD) and "cross machine direction" (CMD) refer, respectively, to a direction aligned with the direction of travel of the papermaker's fabric on the papermaking machine, and a direction parallel to the fabric surface and traverse to the direction of travel. Both weaving methods described hereinabove are well known in the art, and the term "endless belt" as used herein refers to belts made by either method.

When tissue paper is being formed, typically a forming fabric with a top surface having a relatively fine mesh is employed. Such a fabric can reduce the tendency of the paper to have "pin holes." Also, because tissue paper is typically formed on paper machines that run at high speeds (as much as 6,000 feet per minute) with high permeability fabrics, tissue forming fabrics generally are relatively thin (i.e., of low caliper); low caliper fabrics tend to drain quickly (due to a lesser void volume) and are therefore often more effective than thicker fabrics. In addition, the high operating rate of a tissue forming machine can also cause the "sheet release" properties of a tissue forming fabric to be very important. In contrast to forming fabrics for higher grades of paper, such as printer paper, the "coplanarity" of the papermaking surface is generally less critical for tissue forming fabrics, as a fabric having less coplanar surface can produce a softer paper (which is, of course, an important quality in tissue). Further, a typical tissue forming fabric is "CMD-predominant" on its top surface; i.e., the CMD yarns of the top surface tend to comprise more of the top surface than do the MD yarns and provide much of the fiber support for the paper stock fibers.

The foregoing demonstrates that forming fabrics for tissue paper can have much different performance characteristics than those for forming newsprint, printer paper, and other finer paper grades. As such, forming fabrics suitable for fine paper grades, such as those illustrated in U.S. Pat. Nos. 4,987,929; 5,518,042; and 5,937,914 to Wilson, may not be suitable for the formation of tissue paper. Fabrics that are designed for tissue paper formation, such as those illustrated in U.S. Pat. Nos. 5,025,839 to Wright and 5,857,498 to Barreto, can have insufficient permeability under certain circumstances. One other proposed tissue forming fabric, that illustrated in U.S. Pat. No. 5,421,374 to Wright, addresses the permeability issue by including only one bottom CMD yarn for every three top CMD yarns, but this fabric can have problems with the top CMD yarns bunching together such that there is not uniform spacing between the top CMD yarns.

SUMMARY OF THE INVENTION

In view of the foregoing, it is an object of the present invention to provide a papermaker's fabric suitable for forming tissue paper.

It is another object of the present invention to provide a tissue forming fabric that addresses the permeability and top CMD spacing uniformity problems described above.

These and other objects are satisfied by the present invention, which includes a papermaker's fabric that can provide suitable permeability, surface structure, and top CMD yarn spacing for tissue formation. The papermaker's fabric comprises: a base fabric structure including machine direction yarns and primary cross machine direction yarns interlacing to form a papermaking surface, wherein the machine direction yarns and primary cross machine direction yarns are interlaced in a pattern having a harness repeat of greater than two. The fabric also includes first and second companion cross machine direction yarns positioned between each pair of adjacent primary cross machine direction yarns. Each first companion cross machine direction yarn has an interlacing pattern relative to the machine direction yarns that is identical to a first of the pair of adjacent primary cross machine direction yarns, and each second companion cross machine direction yarn has an interlacing pattern relative to the machine direction yarns that is identical to a second of the pair of adjacent primary cross machine direction yarns. The first companion cross machine direction yarn is positioned between the second primary and companion cross machine direction yarns. The primary cross machine direction yarns have a first diameter, and the first and second companion yarns have a second diameter, wherein the ratio between the first and second diameters is between about 0.9 and 1.1. In this configuration, the companion paper side cross machine direction yarns tend to remain separated from each other, thereby providing a surface structure and a permeability that can suitably produce tissue paper.

In another embodiment, a papermaker's fabric of the present invention comprises machine direction yarns interwoven with first and second sets of top cross machine direction yarns and a bottom set of cross machine direction yarns in a repeat unit. The first and second sets of top cross machine direction yarns are arranged in alternating fashion such that one of the first set of cross machine direction yarns resides between two of the second set of top cross machine direction yarns, and one of the second set of top cross machine direction yarns resides between two of the first set of top cross machine direction yarns. Each of the machine direction yarns of the repeat unit passes below at least one of the bottom machine direction yarns, and each of the machine direction yarns passes either (a) above two adjacent top cross machine direction yarns of the first set and below one of the top cross machine direction yarns of the second set positioned therebetween, or (b) above two adjacent top cross machine direction yarns of the second set and below one of the top cross machine direction yarns of the first set positioned therebetween. This configuration can also provide a surface structure and permeability suitable for forming tissue paper. It is preferred that, in this configuration, the paper side cross machine direction yarns comprising the first set be formed of a material that has a different elastic modulus (i.e., differs in flexibility) than the material from which the paper side cross machine direction yarns are formed.

DETAILED DESCRIPTION OF THE INVENTION

Figure 1:
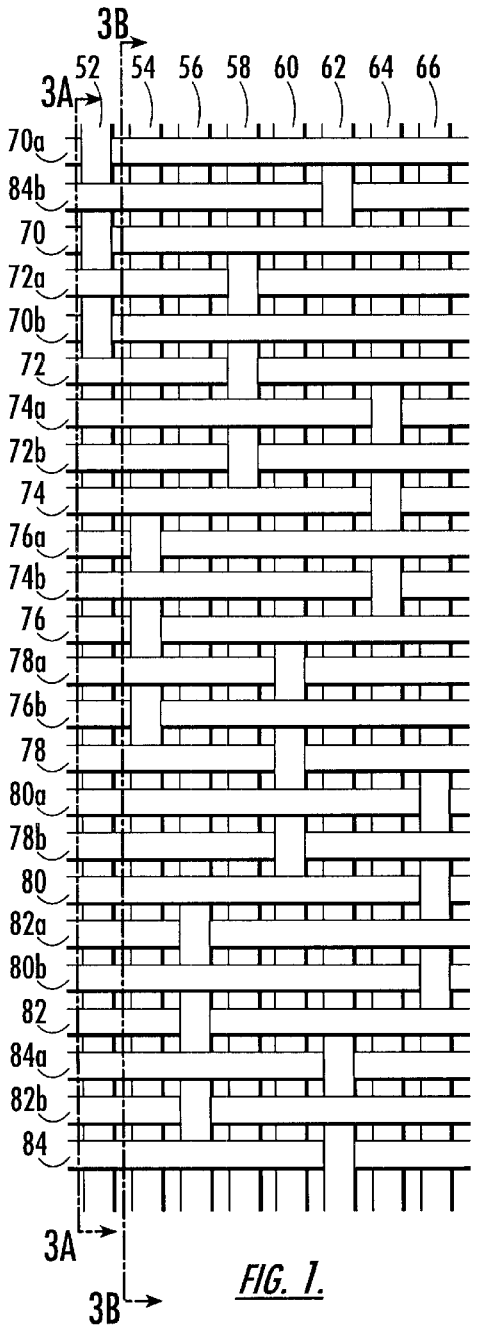
FIG. 1 is a top view of the papermaking surface of a double layer forming fabric of the present invention.

The present invention will now be described more particularly hereinafter with reference to the accompanying drawings, in which present embodiments of the invention are shown. The invention, however, be embodied in many different forms and is not limited to the embodiments set forth herein; rather, these embodiments are provided so that the disclosure will fully convey the scope of the invention to those skilled in the art. Like numbers refer to like components throughout. The dimensions and thicknesses for some components and layers may be exaggerated for clarity.

The present invention is directed to papermakers' woven fabrics. For ease of understanding of the concepts of the invention, the first fabric illustrated herein will be described as if a base fabric layer were initially woven and then additional yarns added. The hypothetical base fabric layer includes MD yarns and CMD yarns referred to as "primary" CMD yarns. The additional yarns are referred to as "companion" CMD yarns. Of course, this fabric embodiment will typically be woven in a one-step weaving process, with the primary CMD yarns and the companion CMD yarns being woven in sequence.

Turning now to the Figures, a double layer fabric, designated broadly at 50, is illustrated in FIGS. 1 through 4. In the illustration in FIG. 1 that encompasses a repeat unit, the fabric 50 includes MD yarns 52, 54, 56, 58, 60, 62, 64, and 66. Eight primary CMD yarns 70, 72, 74, 76, 78, 80, 82, and 84 are interwoven with the MD yarns in a twill pattern such that each CMD yarn passes over seven MD yarns, passes beneath an MD yarn, then repeats this pattern; i.e., the "floats" of the primary CMD yarns 70 through 84 (those portions of the primary CMD yarns which extend over multiple adjacent MD yarns) form a "twill" pattern which extends across the fabric 50 at an angle at approximately 45° to the MD yarns. The eight harness fabric 50 is constructed so that the MD knuckles (locations where an MD yarn passes over a single primary CMD yarn) of adjacent MD yarns are offset in the cross machine direction by three primary CMD yarns; for example, MD yarn 52 passes over primary CMD yarn 70, and MD yarn 54 passes over primary CMD yarn 76.

Figure 2:
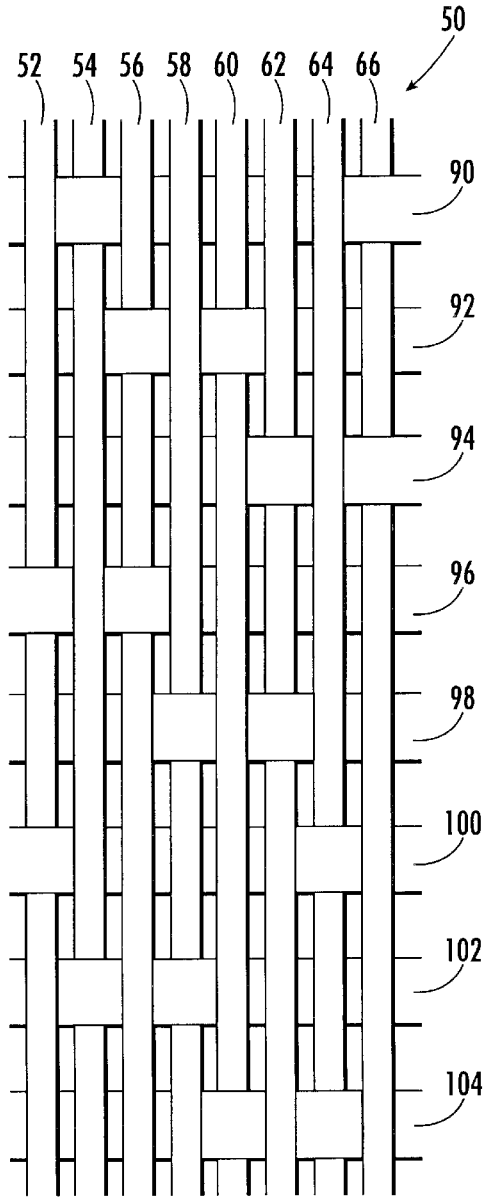
FIG. 2 is a top view of the bottom layer of the double layer forming fabric of FIG. 1.
Figure 3A:
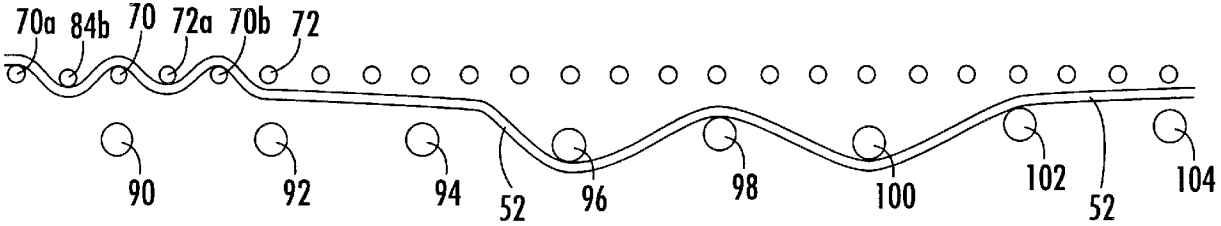
FIGS. 3A and 3B are section views taken along lines 3A—3A and 3B—3B of FIG. 1, respectively, showing the interrelationship between two typical MD yarns, primary CMD yarns, companion CMD yarns, and machine side CMD yarns.
Figure 3B:
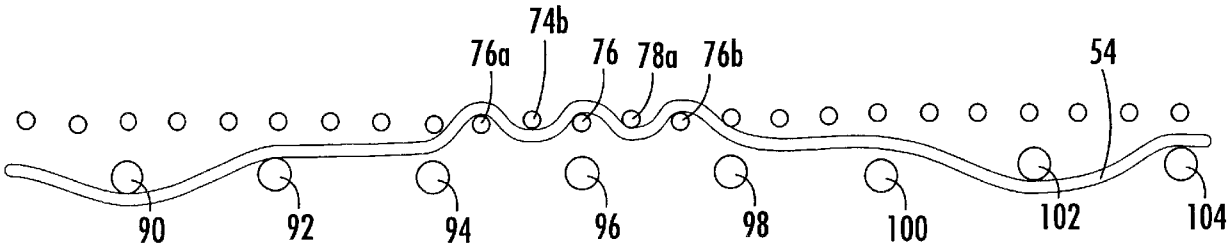
Figure 7B:
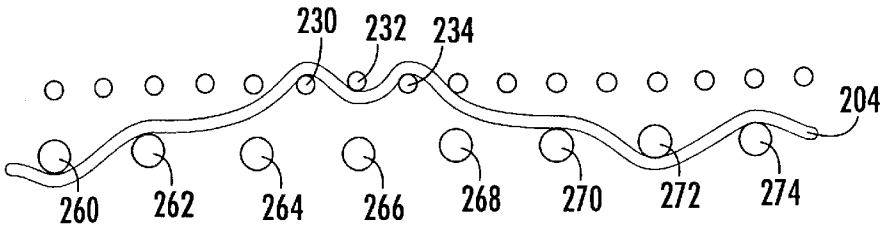
FIGS. 7A and 7B are section views taken along lines 7A—7A and 7B—7B of FIG. 5, respectively, showing the interrelationship between typical MD yarns, primary CMD yarns, companion CMD yarns, and machine side CMD yarns.
Figure 7A:
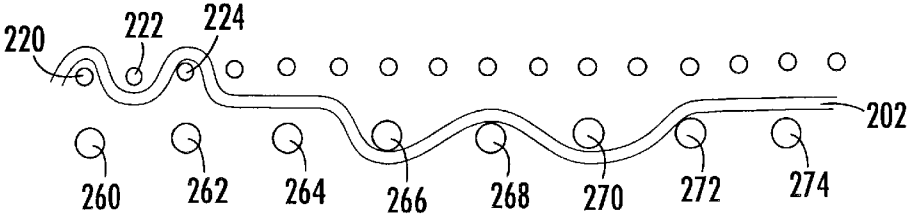
Figure 4:
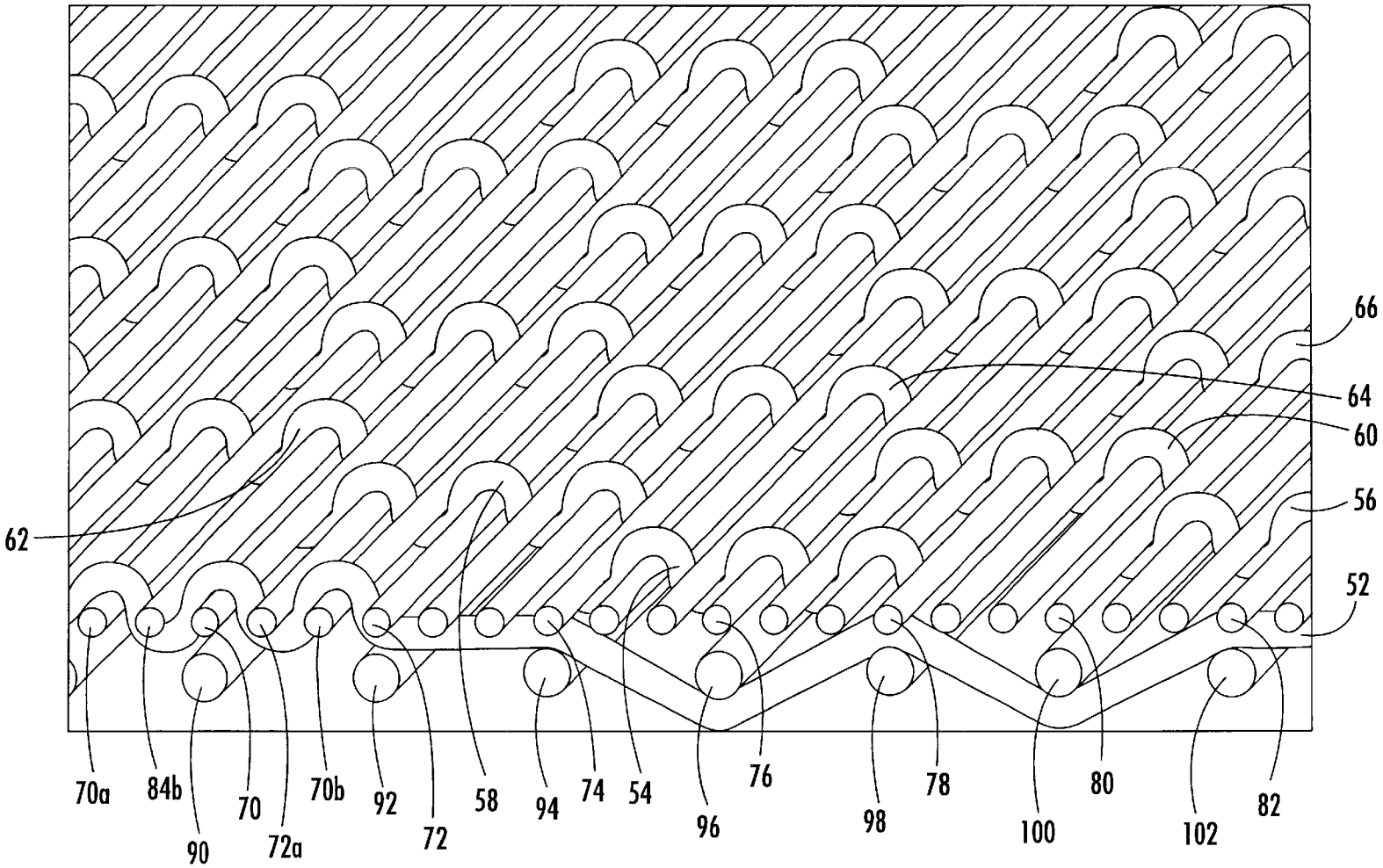
FIG. 4 is an enlarged partial perspective view of the fabric of FIG. 1 showing the interrelationship of companion CMD yarns to one another and to their adjacent primary CMD yarns.

FIG. 2 illustrates the machine side layer of the fabric 50. Machine side CMD yarns 90, 92, 94, 96, 98, 100, 102, and 104 are positioned below the primary CMD yarns 70 through 84 described above, with each machine side CMD yarn preferably being positioned substantially directly beneath a respective paper side primary CMD yarn. In FIGS. 3A and 3B, typical MD yarns 52, 54 are shown passing from the paper side of the fabric 50 to interweave the machine side CMD yarns. Specifically, in this instance, the MD yarn 52 passes over the machine side CMD yarns 90, 92 and 94, under machine side CMD yarn 96, over machine side CMD yarn 98, under machine side CMD yarn 100, and above machine side CMD yarns 102 and 104 (FIG. 3A). Adjacent MD yarn 54 passes below machine side CMD yarn 90, above machine side CMD yarns 92–100, below machine side CMD yarn 102, and above machine side CMD yarn 104. (FIG. 3B).

Referring again to FIGS. 1 and 2, a pair of companion CMD yarns is positioned between each pair of primary CMD yarns. Each companion CMD yarn has the identical weave pattern to a primary CMD yarn separated from it by only one other companion CMD yarn. For clarity, the numerical designation of each companion CMD yarn matches that of the primary CMD yarn with its identical weave pattern, with an "a" or "b" designation added to indicate a companion CMD yarn. Thus, the companion CMD yarn 70*b* has the identical weave pattern to primary CMD yarn 70, companion CMD yarns 72*a*, 72*b* have the identical weave pattern of primary CMD yarn 72, and companion CMD yarns 74*a*, 74*b* have the identical weave pattern to primary CMD yarn 74. The same is true for companion CMD yarns 76*a*, 76*b*, 78*a*, 78*b*, 80*a*, 80*b*, 82*a*, 82*b*, 84*a*, and 84*b*, each of which has the identical weave pattern as the primary CMD yarn with its corresponding designating number (companion CMD yarn 84*a* is located adjacent primary CMD yarn 70 is this repeat unit). In each instance, the companion CMD yarn is separated from its corresponding primary CMD yarn by one other companion CMD yarn, which, of course, is also separated from its corresponding primary CMD yarn by the first companion CMD yarn.

In this configuration, the MD yarns follow an "over 1/under 1/over 1/under 1/over 1" sequence as they interweave with two companion CMD yarns, a primary CMD yarn, and two more companion CMD yarns. For example, MD yarn 58 passes over companion yarn 72*a*, below companion yarn 70*b*, above primary CMD yarn 72, below companion yarn 74*a*, and above companion yarn 72*b*. This sequence can encourage the primary and companion CMD yarns to remain relatively uniformly separated from one another, particularly when the companion CMD yarns are of a similar diameter as the primary CMD yarns and/or are formed of a stiffer material than the primary CMD yarns, as is described in greater detail below.

Preferably, the companion CMD yarns are of a similar, or even essentially identical, diameter as the primary CMD yarns in the fabric 50. The selected sizes of the companion, primary and machine side CMD yarns and the MD yarns are typically governed by the performance requirements of the fabric. Generally, the ratio of the diameters of the companion CMD yarns and the primary CMD yarns should be between about 0.9 and 1.1, with ratio of between about 0.95 and 1.05 being preferred and a ratio of about 1.0 being more preferred. Suitable yarn diameters for the primary, companion and machine side CMD yarns and the MD yarns are shown in the following table:

| Primary CMD yarns | | Companion | Machine Side CMD | MD Yarns | |
|---|---|---|---|---|---|
| Number/ Inch | Dia. (mm) | CMD yarns Dia. (mm) | Yarns Dia. (mm) | Dia. (mm) | Papermaking Application |
| 27 | .15 | .15 | .30 | .17 | fine/news |
| 27 | .20 | .20 | .36 | .22 | brown |
| 30 | .11 | .11 | .25 | .12 | tissue |
| 30 | .13 | .13 | .25 | .12 | fine/tissue |
| 30 | .13 | .13 | .28 | .15 | fine/tissue |
| 33 | .11 | .11 | .22 | .12 | tissue |
| 33 | .11 | .11 | .25 | .15 | tissue |

The form of the yarns utilized in the fabrics of the present invention can vary depending upon the desired properties of the final papermaker's fabric. For example, the yarns may be multifilament yarns, monofilament yarns, twisted multifilament or monofilament yarns, spun yarns, or any combination thereof. Also, the materials comprising yarns employed in the fabric of the present invention may be those commonly used in papermaker's fabric. For example, the yarns may be formed of cotton, wool, polypropylene, polyester, aramid, nylon, or the like. The skilled artisan should select a yarn material according to the particular application of the final fabric. In particular, round monofilament yarns formed of polyester or nylon are preferred.

The primary CMD yarns may be formed of the same material as the companion CMD yarns or be formed of a different material (and preferably a more flexible material) than the companion CMD yarns. For example, the primary CMD yarns may be formed of a medium modulus polyester having a relative elongation of 10 to 20 percent at 3 g per denier, and the companion CMD yarns may be formed of a medium to high modulus polyester having a relative elongation of 3 to 20 percent at 3 g per denier. In this configuration, the MD yarns are more likely to "crimp" as they cross the companion CMD yarns (see FIG. 4). This crimping in the MD yarns as they form single float knuckles (encouraged by the "over 1/under 1/over 1/under 1/over 1" configuration of the MD yarns on the top surface) tends to maintain the companion CMD yarns in their original "as woven" positions within the papermaking surface (rather than pairs of adjacent companion yarns being forced toward each other by uncrimped MD yarns—see U.S. Pat. No. 5,937,914 to Wilson for an explanation of this effect). In their original (and maintained) positions, the companion CMD yarns are relatively uniformly separated from each other, which provides a desirable papermaking surface for forming tissue paper.

The MD yarn crimping can be further encouraged by weaving the MD yarns at a lower tension than is typical. For example, the weaving tension of MD yarns having a diameter of 0.15 mm may be lowered to a level of between about 60 and 120 g per yarn.

In this configuration, the fabric 50 has three paper side CMD yarns for every machine side CMD yarn. As a result, the fabric should have good permeability compared to fabrics with a lower ratio of paper side CMD yarns to machine side CMD yarns. However, the fabric 50 can address the absence of paper side CMD yarn uniformity often found in other fabrics with this 3:1 ratio. It should also be noted that the fabric 50 is also configured such that all of the floats of each primary and companion CMD yarn contribute to the twill line. This twill density can reduce the visual effect of fabric marking on paper produced with the fabric. This concept can be extended to virtually any double layer base fabric, including seven harness double layer fabrics, the structures of which are well-known to those skilled in this art and need not be described in detail herein.

Those skilled in this art will appreciate that this concept of companion yarns can be applied to virtually any fabric, including plain weaves, twills, satins, and the like. It can be employed as the paper side of single, double and triple layer fabrics, whether interlaced by common MD yarns (such as the fabric 50) or formed as separate fabric layers of a laminated fabric, such as those described in U.S. Pat. No. 5,277,967 to Zehle. It is preferred that the fabrics of the present invention have a harness repeat of greater than 2 (i.e., for fabrics other than 1×1 plain weave fabrics).

The positive impact of the "over 1/under 1/over 1" configuration on crimping of MD yarns and, consequently, maintenance of separation of paper side CMD yarns may also be seen in an alternative fabric embodiment, designated broadly at 200 in FIGS. 5 through 8. The fabric 200 comprises eight MD yarns 202, 204, 206, 208, 210, 212, 214, 216 interwoven with sixteen paper side CMD yarns 220, 222, 224, 226, 228, 230, 232, 234, 236, 238, 240, 242, 244, 246, 248, 250 and eight machine side CMD yarns 260, 262, 264, 266, 268, 270, 272, 274. The paper side CMD yarns can be subdivided into two sets of alternating yarns: one set being paper side CMD yarns 220, 224, 228, 232, 236, 240, 244 and 248, and the second set of paper side CMD yarns being 222, 226, 230, 234, 238, 242, 246 and 250.

Figure 5:
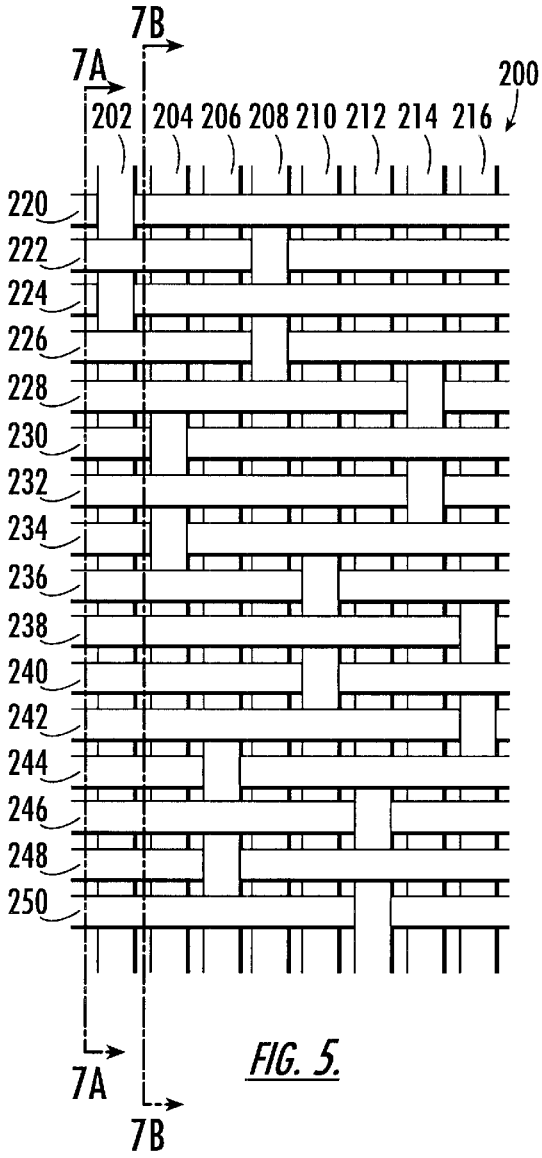
FIG. 5 is a top view of the papermaking surface of an alternative double layer forming fabric embodiment of the present invention.

As can be seen in FIG. 5, each MD yarn passes above one paper side CMD yarn, below the immediately adjacent paper side CMD, above the next adjacent paper side CMD yarn, and below the remaining CMD paper side yarns. For example, the MD yarn 202 passes over paper side CMD yarn 220, below paper side CMD yarn 222, over paper side CMD yarn 224, and below the remaining paper side CMD yarns. The remaining MD yarns also have this "over 1/under 1/over 1" pattern with paper side CMD yarns.

Notably, each MD yarn passes over two paper side yarns that are either both in the first set or both in the second set of paper side CMD yarns, and each MD yarn passes under a paper side CMD yarn that is not in the set of paper side yarns that the MD yarns passes over. Again using MD yarn 202 as an example, it passes over paper side CMD yarns 220 and 224, each of which are in the first set of paper side CMD yarns as defined above, and below paper side CMD yarn 222, which is in the second set of paper side CMD yarns.

Adjacent MD yarns are offset from each other in the machine direction by either five or seven paper side CMD yarns. For example, MD yarn 202 first passes over paper side CMD yarn 220, while adjacent MD yarn 204 first passes over paper side yarn 230, which is five yarns away from paper side CMD yarn 220 in the machine direction. MD yarn 206 first passes over paper side CMD yarn 244, which is seven paper side CMD yarns away from the paper side CMD yarn 230 first passed over by adjacent MD yarn 204. This alternating offset of five paper side CMD yarns, then seven paper side CMD yarns, for adjacent MD yarns continues throughout the repeat unit.

As a result of this weave pattern, the "companion" yarn concept of the fabric 50 described above is extended to the fabric 200 also. Each paper side CMD yarn has the identical weave pattern to another paper side CMD yarn separated from it by one paper side CMD yarn. For example, paper side CMD yarns 220 and 224 both pass under MD yarns 202 and 208 and over the other MD yarns. This pattern forms the "over1/under1/over1" pattern described above that can encourage desirable crimping in the MD yarns.

Figure 6:
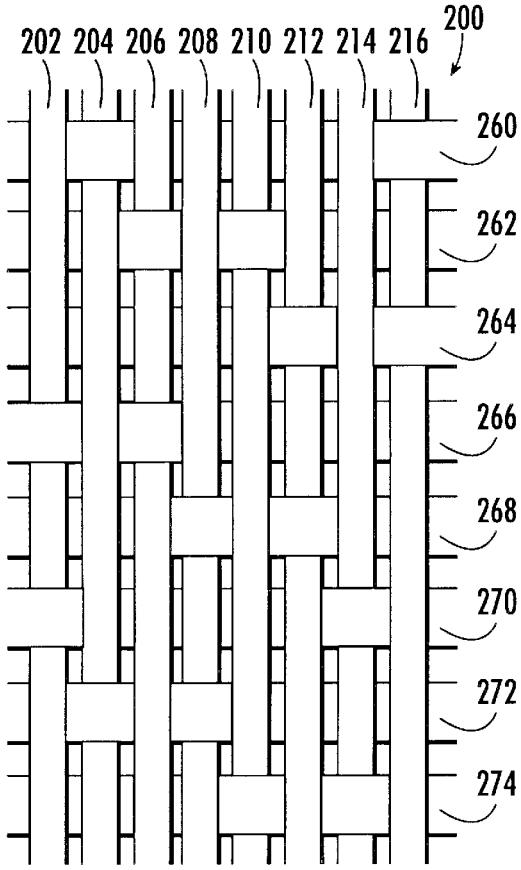
FIG. 6 is a top view of the bottom layer of the double layer forming fabric of FIG. 5.
Figure 8:
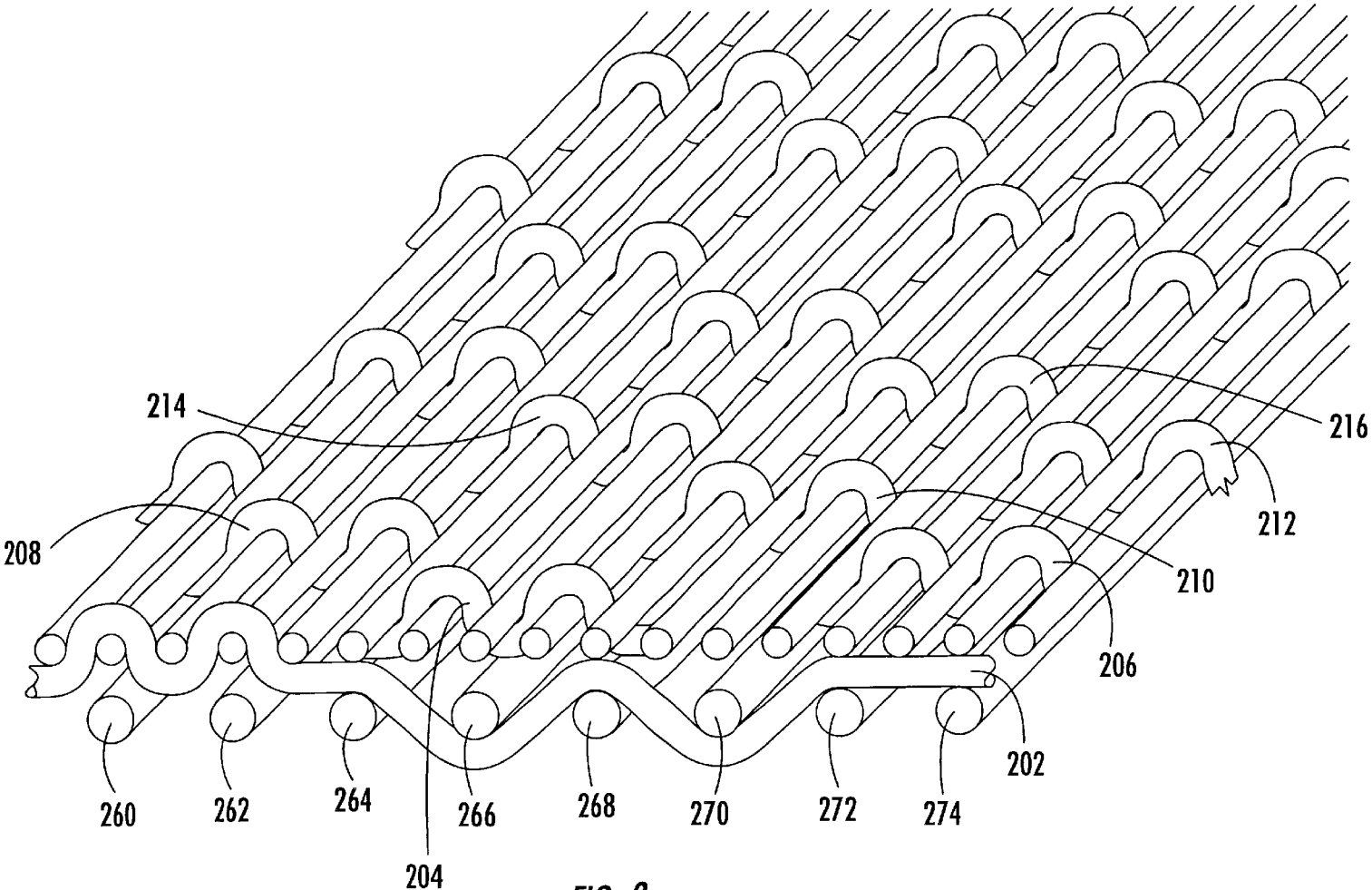
FIG. 8 is an enlarged partial perspective view of the fabric of FIG. 5 showing the interrelationship of companion CMD yarns to one another and to their adjacent primary CMD yarns.

Referring now to FIG. 6, the machine side of the fabric is formed by the interweaving of the MD and machine side CMD yarns. One machine side CMD yarn is positioned generally beneath a respective paper side CMD yarn. Each MD yarn passes below two machine side CMD yarns separated by one machine side CMD yarn. For example, MD yarn 202 passes below machine side CMD yarns 266 and 270 (passing over machine side CMD yarn 268 that is positioned between machine side yarns 268, 272). Similarly, MD yarn 204 passes below machine side CMD yarns 272 and 260 and above machine side CMD yarn 272 (yarn 260 would be the next machine side CMD yarn in the repeat unit). Notably, half of the MD yarns (exemplified by MD yarn 202 in FIG. 7A), after passing above a paper side CMD yarn, pass above one machine side CMD yarn before passing below a machine side CMD yarn, while the other half of the MD yarns (exemplified by MD yarn 204 in FIG. 7B), pass above two machine side CMD yarns after passing over a paper side CMD yarn before passing below a machine side CMD yarn.

The sizes, materials and configurations of the yarns for the fabric 200 can take the form described hereinabove for the fabric 50. An exemplary fabric is formed of MD yarns having a diameter of 0.15 mm, paper side CMD yarns having a diameter of 0.11 mm, and machine side CMD yarns having a diameter of 0.25 mm. Like the fabric 50 described above, it may be desirable to reduce the typical weaving tension for the MD yarns. Also as with the fabric 50, it may be desirable to form some of the paper side CMD yarns of a more flexible material.

In this configuration, the fabric 200 can provide a desirable combination of permeability and fiber support for tissue forming fabrics. The top surface of the fabric 200 includes the "over 1/under 1/over 1" MD yarn weaving pattern that can encourage MD yarn crimping and, as a result, uniform separation of paper side CMD yarns. Accordingly, the fabric can furnish a suitable surface for forming tissue paper.

It should also be understood that, although fabrics for forming tissue have been discussed herein, this concept can be extended to fabrics for forming other types of paper. For example, similar weave patterns can be used to form brown paper by increasing yarn size, including one embodiment following the weave pattern illustrated in FIGS. 1 through 4 in which paper side CMD yarns having a diameter of 0.23 mm, machine side CMD yarns having a diameter of 0.40 mm, and machine direction yarns having a diameter of 0.27 mm are employed. Those skilled in this art will recognize other extensions of this concept can apply to other types of paper.

The foregoing embodiments are illustrative of the present invention, and are not to be construed as limiting thereof. The invention is defined by the following claims, with equivalents of the claims to be included therein.

That which is claimed is:

1. A papermaker's fabric, comprising:

a base fabric structure including machine direction yarns and primary cross machine direction yarns interlacing to form a papermaking surface, said machine direction yarns and primary cross machine direction yarns being interlaced in a pattern having a harness repeat of greater than two;

first and second companion cross machine direction yarns positioned between each pair of adjacent primary cross machine direction yarns;

wherein each first companion cross machine direction yarn has an interlacing pattern relative to said machine direction yarns that is identical to a first of said pair of adjacent primary cross machine direction yarns, and wherein each second companion cross machine direction yarn has an interlacing pattern relative to said machine direction yarns that is identical to a second of said pair of adjacent primary cross machine direction yarns, and wherein said first companion cross machine direction yarn is positioned between said second primary and companion cross machine direction yarns; and wherein said primary cross machine direction yarns have a first diameter, and said first and second companion yarns have a second diameter, and the ratio between said first and second diameters is between about 0.9 and 1.1.

2. The papermaker's fabric defined in claim 1, wherein said second companion cross machine direction yarn is positioned between said first primary and companion cross machine direction yarns.

3. The papermaker's fabric defined in claim 1, wherein said repeating harness pattern is a twill pattern.

4. The papermaker's fabric defined in claim 3, wherein said twill pattern is a 2×1 twill pattern.

5. The papermaker's fabric defined in claim 1, wherein said ratio between said first and second diameters is between 0.95 and 1.05.

6. The papermaker's fabric defined in claim 1, wherein said ratio between said first and second diameters is about 1.0.

7. The papermaker's fabric defined in claim 1, wherein said primary cross machine direction yarns are formed of a first material, and said companion cross machine direction yarns are formed of a second material that differs from said first material.

8. The papermaker's fabric defined in claim 7, wherein said second material has a higher stiffness than said first material.

9. The papermaker's fabric defined in claim 1, further comprising additional cross machine direction yarns interlaced with said machine direction yarns to form a machine side surface.

10. A papermaker's fabric, comprising:

a base fabric structure including machine direction yarns and primary cross machine direction yarns interlacing to form a papermaking surface, said machine direction yarns and primary cross machine direction yarns being interlaced in a pattern having a harness repeat of greater than two, said base fabric structure further including a second set of cross machine direction yarns interlaced with said machine direction yarns to form a machine side surface of said fabric;

first and second companion cross machine direction yarns positioned between each pair of adjacent primary cross machine direction yarns;

wherein each first companion cross machine direction yarn has an interlacing pattern relative to said machine direction yarns that is identical to a first of said pair of adjacent primary cross machine direction yarns, and wherein each second companion cross machine direction yarn has an interlacing pattern relative to said machine direction yarns that is identical to a second of said pair of adjacent primary cross machine direction yarns, and wherein said first companion cross machine direction yarn is positioned between said second primary and companion cross machine direction yarns; and wherein said primary cross machine direction yarns have a first diameter, and said first and second companion yarns have a second diameter, and the ratio between said first and second diameters is between about 0.9 and 1.1.

11. The papermaker's fabric defined in claim 10, wherein said second companion cross machine direction yarn is positioned between said first primary and companion cross machine direction yarns.

12. The papermaker's fabric defined in claim 10, wherein said repeating harness pattern is a twill pattern.

13. The papermaker's fabric defined in claim 12, wherein said twill pattern is a 2×1 twill.

14. The papermaker's fabric defined in claim 10, wherein said ratio between said first and second diameters is between 0.95 and 1.05.

15. The papermaker's fabric defined in claim 10, wherein said ratio between said first and second diameters is about 1.0.

16. The papermaker's fabric defined in claim 10, wherein said primary cross machine direction yarns are formed of a first material, and said companion cross machine direction yarns are formed of a second material that differs from said first material.

17. The papermaker's fabric defined in claim 16, wherein said second material has a higher stiffness than said first material.

18. A papermaker's fabric, comprising:

machine direction yarns interwoven with first and second sets of top cross machine direction yarns and a bottom set of cross machine direction yarns in a repeat unit, said first and second sets of top cross machine direction yarns being arranged in alternating fashion such that one of said first set of cross machine direction yarns resides between two of said second set of top cross machine direction yarns, and one of said second set of top cross machine direction yarns resides between two of said first set of top cross machine direction yarns, wherein each of said machine direction yarns of said repeat unit passes below at least one of said bottom machine direction yarns, and each of said machine direction yarns passes either (a) above two adjacent top cross machine direction yarns of said first set and below one of said top cross machine direction yarns of said second set positioned therebetween, or (b) above two adjacent top cross machine direction yarns of said second set and below one of said top cross machine direction yarns of said first set positioned therebetween.

19. The papermaker's fabric defined in claim 18, wherein said first and second sets of top cross machine direction yarns have, respectively, first and second diameters, and wherein the ratio between said first and second diameters is between 0.9 and 1.1.

20. The papermaker's fabric defined in claim 18, wherein said ratio between said first and second diameters is about 1.0.

21. The papermaker's fabric defined in claim 18, wherein said first set of top cross machine direction yarns are formed of a first material, and said second set of cross machine direction yarns are formed of a second material that differs from said first material.

22. The papermaker's fabric defined in claim 21, wherein said second material has a higher stiffness than said first material.

23. A method of making paper, comprising the steps of:

providing a papermaker's fabric, said papermaker's fabric comprising:

a base fabric structure including machine direction yarns and primary cross machine direction yarns interlacing to form a papermaking surface, said machine direction yarns and primary cross machine direction yarns being interlaced in a pattern having a harness repeat of greater than 2;

two companion cross machine direction yarns positioned between each pair of adjacent primary cross machine direction yarns;

wherein each first companion cross machine direction yarn has an interlacing pattern relative to said machine direction yarns that is identical to a first of said pair of adjacent primary cross machine direction yarns, and wherein each second companion cross machine direction yarn has an interlacing pattern relative to said machine direction yarns that is identical to a second of said pair of adjacent primary cross machine direction yarns, and wherein said first companion cross machine direction yarn is positioned between said second primary and companion cross machine direction yarns; and wherein said primary cross machine direction yarns have a first diameter, and said first and second companion yarns have a second diameter, and the ratio between said first and second diameters is between about 0.9 and 1.1;

applying paper stock to said papermaker's fabric; and removing moisture from said paper stock.

* * * * *